US005524519A

United States Patent [19]

Matsunaga et al.

[11] Patent Number: 5,524,519

[45] Date of Patent: Jun. 11, 1996

[54] PIANO PROVIDED WITH A MECHANISM FOR CONTROLLING STRING STRIKING MOVEMENT

[75] Inventors: Hiroshi Matsunaga; Hisamitsu Honda, both of Hamamatsushi, Japan

[73] Assignee: Kabushiki Kaisha Kawai Gakki Seisakusho, Hamamatsushi, Japan

[21] Appl. No.: 268,247

[22] Filed: Jun. 29, 1994

[30] Foreign Application Priority Data

| | | | |
|---|---|---|---|
| Jun. 30, 1993 | [JP] | Japan | 5-162010 |
| Sep. 27, 1993 | [JP] | Japan | 5-240030 |
| Feb. 10, 1994 | [JP] | Japan | 6-016632 |

[51] Int. Cl.[6] ..... G100 3/18

[52] U.S. Cl. ..... 84/221; 84/236; 84/615

[58] Field of Search ..... 84/170, 171, 216, 84/221, 236, 615

[56] References Cited

U.S. PATENT DOCUMENTS 5,374,775 12/1994 Kawamura et al. ..... 84/170 X

*Primary Examiner*—Patrick J. Stanzione
*Attorney, Agent, or Firm*—Davis, Bujold & Streck

[57] ABSTRACT

In a piano mechanism, the sound volume can be effectively controlled without changing the feel of the key or tone quality. A hammer regulating button projecting from a hammer rail contacts the upper face of a catcher just before a hammer strikes a string. By restricting the string striking movement, the volume of string striking sound is controlled, irrespective of the mechanical operation of a jack or other associated transmitting components responsive to the key depressing. No cushioning material is required between hammer and string. In a piano having an electronic sound source built therein, even when the keys are depressed, the hammer can be stopped from striking strings by the provision of a hammer shank stop rail and a catcher regulating button. Therefore, without generating a string striking sound, sounds are generated from the electronic sound source. By manually turning an adjusting screw of the catcher regulating button, the position of the hammer when stopped can be adjusted. Therefore, even after repeated use, the string striking movement can be positively stopped.

6 Claims, 12 Drawing Sheets

TO LEVER 149

PIANO PROVIDED WITH A MECHANISM FOR CONTROLLING STRING STRIKING MOVEMENT

FIELD OF THE INVENTION

This invention relates to a piano, in which, by restricting the moving inertia of hammers, the sound volume can be controlled. The invention also relates to a piano in which the movement of hammers can be stopped and electronic sounds are generated responsive to the operation of keyboard.

BACKGROUND OF THE INVENTION

In a conventional piano, the external force applied when a keyboard is operated results in the movement of a hammer system causing the hammer to strike the string and generate sound. In consideration of housing conditions or the necessity of practicing finger movement, a soft pedal mechanism or a muffler mechanism has been used to soften or dampen the piano tone.

In the soft pedal mechanism, the hammer rail provided at the back of the hammer system is moved by operating a soft pedal, thereby making the distance between hammer and string at their stationary position shorter than that when normal sound volume is generated. The velocity of the hammer at its striking position is reduced, thereby restricting the volume of sound generated by the string struck by the hammer.

In the muffler mechanism, felt or other cushioning material is interposed between hammer and string. The hammer strikes the strings indirectly via the cushioning material, thereby dampening the sound volume.

In the conventional soft pedal mechanism, the distance between hammer and string is restricted. Thus, the distance to be reduced by moving the hammer rail is also restricted. To effectively dampen the sound volume, however, the distance between hammer and string needs to be largely reduced. If the hammer is too close to the string, the feel of the key upon operating the keyboard is changed, or sound may be accidentally generated by the operation of the soft pedal without operating the keyboard.

In the conventional muffler mechanism, since the hammer strikes the strings indirectly via the cushioning material, the tone quality is softened. Hard tone, which is the normal piano tone, cannot be made. Thus, the characteristic piano tone cannot be made.

Conventionally, by combining an acoustic piano with an electronic sound source, electronic sound as well as the normal piano performance can be achieved. But, string striking sound can be prevented from being generated from the electronic sound source by the hammer shank stop rail preventing the hammer from striking the string. If the keys are operated such that the electronic sound is generated based on depressing or releasing the keys, the hammer shank contacts the cushioning felt provided on the hammer shank stop rail before the hammer strikes the string, thereby stopping the movement of the hammer. Therefore, no string striking sound is produced. By using this mechanism together with headphone, a player can play the piano by operating the keyboard and listen to the electronic sound through the headphone, while string striking sound is not heard outside. The piano may be freely played at night or in an apartment house, housing complex or other densely built-up area requiring sound suppression.

In the aforementioned conventional piano, the portion of cushioning felt provided on the hammer shank stop rail corresponding to the hammer's string striking position becomes deformed with repeated use. This is especially true in the case of an often used key. This deformed portion of the cushioning felt cannot stop the corresponding hammer at the originally specified position. Gradually, the deformed portion is worn down so that the hammer is allowed to strike the strings, thereby producing sound.

To avoid the production of string striking sound, the cushioning felt must be replaced often. The replacement is intricate and costly.

SUMMARY OF THE INVENTION

Wherefore, an object of this invention is to provide a piano in which the piano sound volume can be effectively reduced without changing the feel of the key or tone quality.

Another object of the invention is to provide a piano using an electronic sound source in addition to the normal piano performance, which can easily and positively prevent the string striking sound from being generated during the performance using the electronic sound source even after repeated use.

To attain these or other objects, the invention provides a piano provided with a hammer system for striking strings by the movement caused by an external force applied when the keyboard is operated. A mechanical arrangement is disposed between the hammer system and the keyboard for contacting both the hammer system and the keyboard for transmitting the applied external force to the hammer system, thereby causing a hammer of the hammer system to move. A restricting mechanism is further provided for restricting the movement of the hammer system to a specified position between the hammer system rest position and the string striking position.

The restricting mechanism is provided with an adjusting mechanism for adjusting the specified position at which the hammer system is stopped.

In the piano, the restricting mechanism restricts the moving inertia of the hammer system by contacting the hammer system from when the hammer system starts moving until it strikes strings.

The external force applied when the keyboard is operated is transmitted through the mechanical arrangement to the hammer system. After the transmission, the mechanical arrangement is disconnected from the hammer system. The hammer system then under its moving inertia strikes the string, thereby generating sound. The moving inertia of the hammer system is restricted by the restricting mechanism at a specified position from when the movement of the hammer system is started until the hammer system strikes strings.

By the provision of the aforementioned restricting mechanism, the string striking velocity of the hammer system can be controlled independent of the mechanical arrangement and the keyboard thereby lowering the volume of string striking sound. Specifically, without changing the key feel or without accidentally generating pedal operating sound or without changing the tone quality, the piano sound volume can be effectively controlled.

Since the amount of movement of the hammer system restricted by the restricting mechanism can be adjusted by the adjusting mechanism, a desired volume of piano sound can be produced.

The restricting mechanism of the piano can be positioned to contact the hammer system after the start of movement of the hammer but prior to the hammer striking the string, thereby restricting the moving inertia of the hammer. Therefore, the piano sound volume can be effectively controlled without changing the key touch during operation of the keyboard, without generating any pedal operating sound, or without changing the tone quality.

The invention further provides a piano provided with a hammer system for striking the string when a keyboard is operated, and an electronic sound source system for controlling an electronic sound source responsive to the operation of the keyboard. A stopping member is provided in each key range for stopping the hammer at a specified position when the electronic sound source is used. The key range can include any number of keys. The specified position is adjustable for each key range.

The stopping member is provided with a movable carriage, a positioning member for positioning the movable carriage at a first or second position, a stopper and an adjusting member. The stopper is located on the movable carriage for the hammer system of each key range. When the movable carriage is in the first position, the hammer system is prevented from striking the string by stopping the hammer at a specified position. When the movable carriage is in the second position, the hammer system is allowed to strike the string. The amount of projection of the stopper from the movable carriage is adjusted by the adjusting member.

The stopping member prevents the hammer from striking the string by contacting a hammer catcher at a specified position.

According to the invention, when the electronic sound source is controlled based on the keyboard operation, the hammer system mounted in each key range composed of at least one key is prevented from striking the string by restricting the hammer movement an a specified position. The specified position can be adjusted for each key range.

When a piano key is repeatedly used, the portion of the stopping member for stopping the string striking movement of the hammer becomes deformed due to the impact force of the hammer striking movement. The hammer cannot be restricted to the originally specified position because this position shifts from the originally specified position toward the string. Therefore, each key range has an individual adjusting means. Specifically, the adjustment is made such that the location of the hammer when the hammer is stopped by the stopping member becomes identical to the location of the hammer at the originally specified position. Consequently, the hammer is prevented from contacting the string when the electronic sound source is used for the performance.

Even after the repeated use in the electronic sound source mode, the generation of string striking sound can be avoided simply by adjusting the stopping position of the stopping member.

The specified position at which the hammer is prevented from striking strings can be adjusted for each key range.

Since the stopping member is disposed such that it can contact the catcher of the hammer at the front side of the piano, the stopping position can be easily adjusted without disassembling the string striking mechanism or other components.

BRIEF DESCRIPTION OF THE DRAWINGS

The invention will now be described, by way of example, with reference to the drawings, in which.

DETAILED DESCRIPTION OF THE PREFERRED EMBODIMENTS

THE FIRST EMBODIMENT

Figure 1:
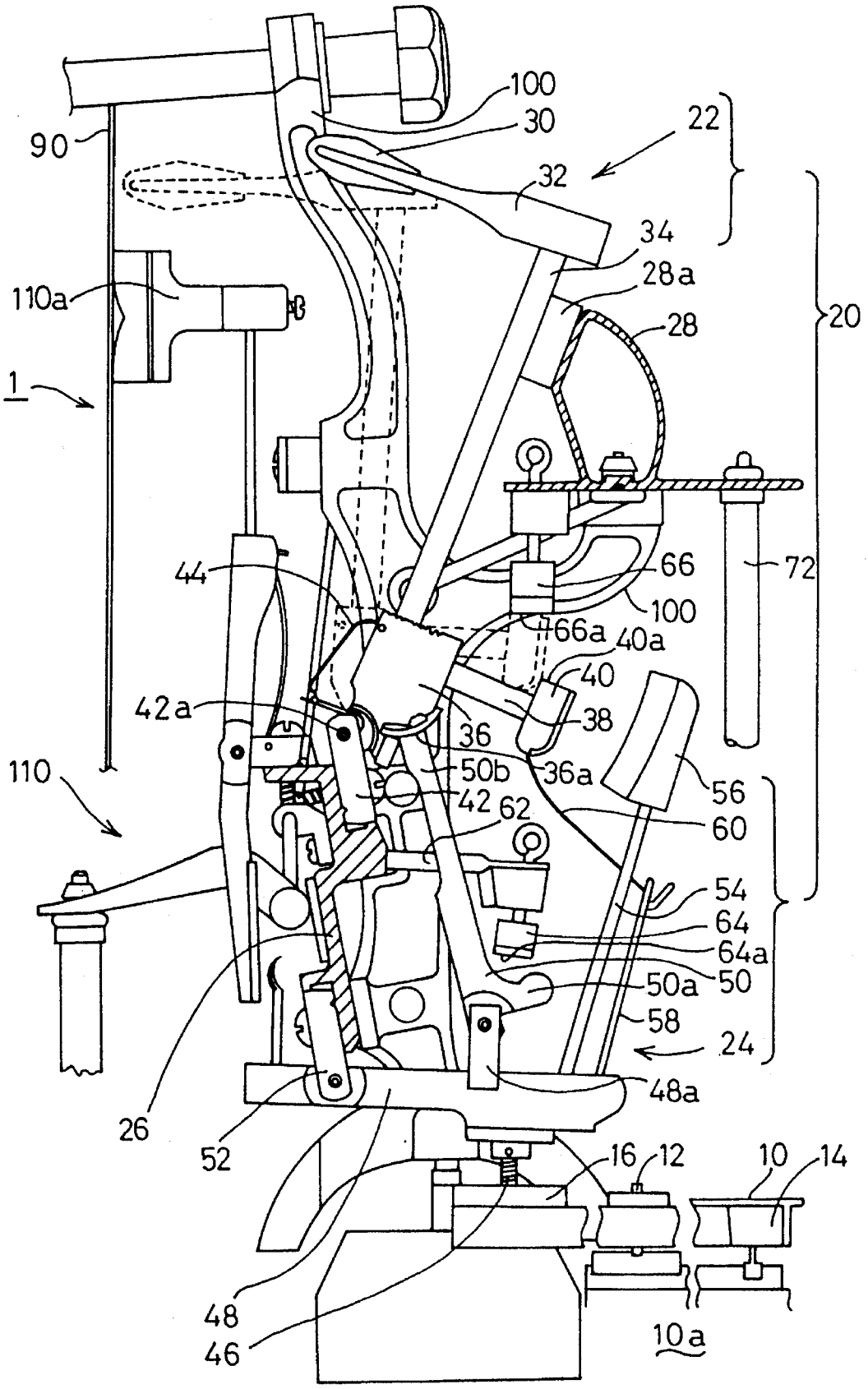
FIG. 1 is a diagrammatic representation showing the sound generating mechanism for one key of an upright piano embodying the invention.

In the first embodiment, as shown in FIG. 1, an upright piano 1 has eighty-eight keys 10 (only one key is shown in this figure), a converting mechanism 20 for converting key depression to the string striking movement, eighty-eight sets of strings 90 (only one string is shown in this figure) struck respectively via the converting mechanism 20, and a support mechanism provided along the entire width extending over all the eighty-eight keys for supporting each converting mechanism 20. An action bracket 100 extends vertically and is provided at divide points along the entire width to divide the width into three or four divisions. A damper pedal mechanism 110 is disposed adjacent to each of the strings 90 for adjusting the contact of a damper 110*a* against the string 90.

The key 10 provided on a key bed 10*a* is balanced and pivoted on a balance pin 12. When the front portion 14 of the key 10 is depressed toward the key bed 10*a*, the back portion 16 of the key 10 is lifted upward.

The converting mechanism 20 is provided with a string striking portion 22 for striking strings responsive to the key depression and with a transmitting portion 24 for transmitting the key depression to the string striking portion 22. The support mechanism is provided with a center rail 26 for supporting the structural members of the string striking portion 22 and transmitting portion 24. The support mechanism also has a hammer rail 28 mounted on the side of the string striking portion 22 opposite the string 90. The hammer rail 28 holds the string striking portion 22 in a stationary position when the key is not depressed.

The string striking portion 22 comprises a mallet-formed wooden hammer 32 having a stone-ax-formed head having a hammer felt 30, a wooden hammer shank 34 connected at one end to the hammer 32 for holding the hammer 32, and a hammer butt 36 pivotably connected to the opposite end of the hammer shank 34. The string striking portion 22 is also composed of a wooden catcher shank 38 projecting from the hammer butt 36 and extending perpendicular to the hammer shank 34. The string striking portion 22 is further provided with a catcher 40 attached to the tip of the catcher shank 38. The vibration caused in the string striking portion 22 when the string 90 is struck is eased by the catcher 40.

The hammer butt 36 is pivotably attached to a center pin 42*a* of the support member 42 which is firmly secured to the center rail 26. A butt wire spring 44 spans between the support member 42 and the hammer butt 36 for biasing the hammer butt 36 in a direction opposite to the string striking direction.

The transmitting portion 24 is composed of an action lever 48 attached to the back portion 16 of the key 10 via capstan button 46 and pivotably attached to an L-shaped jack 50 via a support member 48*a*. In the stationary condition, the upper end of jack 50 abuts on the lower portion 36*a* of the hammer butt 36.

The action lever 48 is pivotably supported by the lower end of a mounting member 52 which is firmly attached to the center rail 26. Support rod 54, located above the action lever 48, is slightly tilted in the direction away from the string 90 and has a back check 56 on its tip. After the string 90 is struck, the catcher 40 returns to its initial position and is received by the back check 56 for absorbing the vibration of the string striking portion 20. The contact portions of the catcher 40 and the back check 56 are covered with felt.

One end of a bridle tape 60, consisting of a narrow strip, is firmly tied to the tip of a metal rod 58 attached to action lever 48, which extends substantially parallel to the support rod 54. The other end of the bridle tape 60 is tied to the lower end of the catcher 40. When the back check 56 contacts the catcher 40, the bridle tape 60 assists in damping the vibration caused in the string striking portion 22 when the string 90 is struck.

An extension 62, one end of which is firmly attached to the center rail 26, extends toward the jack 50. A regulating member or button 64 projects downward from the lower face of the extension 62 for contacting a jack tail 50*a* when the jack 50 is moved upward responsive to key depression. The amount of projection of the regulating button 64 from the extension 62 can be adjusted. The regulating button 64 has a lower face 64*a* covered with a cushioning felt for easing the impact resulting from the contact with the jack tail 50*a*. when a key is depressed, the jack 50 moves upward until the jack tail 50*a* hits the lower face 64*a* of the regulating button 64. Subsequently, the jack 50 starts to rotate about the tip of the support member 48*a* in a clockwise direction as viewed in FIG. 1, causing the abutment end 50*b* of the jack 50 to become disconnected from the lower portion 36*a* of the hammer butt 36.

A cushioning portion 28*a* is attached to the hammer rail 28 for receiving the hammer shank 34 after the hammer 32 strikes the string 90 to damp the vibration of the string striking portion 22. A hammer regulating member or button 66 projects downward from the lower face of the hammer rail 28 for contacting the upper face 40*a* of the catcher 40 just before the hammer 32 strikes the string 90, thereby stopping the string striking portion 22 from striking string 90 and controlling the sound volume. The amount of projection of the hammer regulating button 66 from the hammer rail 28 can be adjusted. The lower face 66*a* of the hammer regulating button 66 is covered with a cushioning felt for damping the impact force made when the catcher 40 hits the lower face 66*a*.

Figure 2:
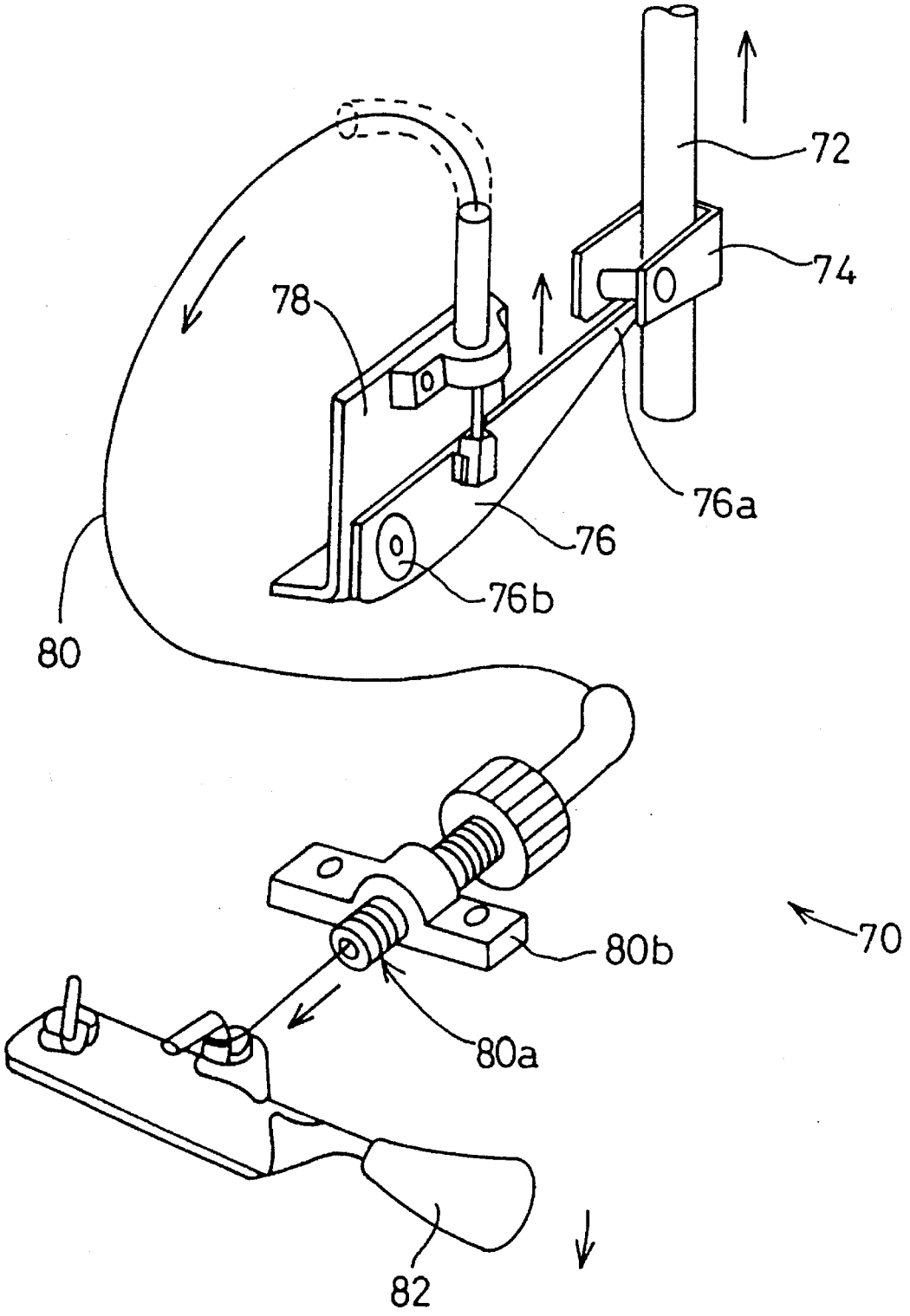
FIG. 2 is a perspective view showing the wire pedal mechanism mounted on the lower part of the upright piano.

A wire pedal mechanism 70 is provided as shown in FIG. 2, to disengage volume control. By thrusting the hammer rail 28 upward, the hammer regulating button 66 is prevented from contacting the catcher 40 as the hammer 32 moves toward the string 90.

As shown in FIG. 2, a rod 72 is connected at one end to the hammer rail 28 for moving the hammer rail 28 upward. A bracket 74 is fixed and is engaged with the tip 76*a* of a link member 76 adjacent to the opposite end of rod 72. The support end 76*b* of the link member 76 is pivotably connected to a frame 78. When the link member 76 is rotated upward about the support end 76*b*, the tip 76*a* pushes the bracket 74 upward. One end of a wire 80 is securely attached to a portion of link member 76 between the tip 76*a* and the support end 76*b*. The opposite end of the wire 80 is connected to an operation lever or portion 82. By operating the portion 82 and pulling the associated end of the wire 80, the link member 76 is allowed to rotate about its support end 76*b* and move upward. By turning an adjusting bolt 80*a* relative to a support frame 80*b*, the amount of pull on the wire 80 can be adjusted.

During operation of the upright piano 1 having the aforementioned structure, when the key 10 is depressed, the back portion 16, balanced on the balance pin 12, moves upward. Such movement is transmitted via the capstan button 46 to the action lever 48, thereby rotating the action lever 48 in a counterclockwise direction about the mounting member 52.

When the action lever 48 rotates counterclockwise, the jack 50 moves upward until the jack tail 50*a* contacts the lower face 64*a* of the regulating button 64. Concurrently, the hammer butt 36 rotates about the center pin 42*a* of the support member 42 in a direction toward the string 90.

After the jack tail 50*a* of the jack 50 contacts the lower face 64*a* of the regulating button 64, the action lever 48 continues to rotate. The jack 50 rotates about the tip of the support member 48*a*, while the end 50*b* of the jack 50 is disengaged from the lower portion 36*a* of the hammer butt 36. Subsequently, the string striking portion 22 rotates about the center pin 42*a* of the support member 42 in a direction toward the string 90. Thus, the string striking movement is started, driven by the inertia and dead weight of the string striking portion 22.

Since the string striking portion 22 rotates about the center pin 42*a* in a counterclockwise direction, as viewed in FIG. 1, the upper face 40*a* of the catcher 40 contacts the lower face 66*a* of the hammer regulating button 66 just before the hammer 32 strikes the string 90. The contact between the faces 40*a* and 66*a* results in a braking force applied to the string striking movement. Therefore, the energy of the string striking portion 22 is reduced remarkably, and thus the struck string 90 generates a remarkably small sound.

By operating the portion 82, the wire 80 is pulled, and the link member 76 rotates about the support end 76*b* and is raised. The tip 76*a* of the link member 76 pushes the bracket 74 up, thereby raising the rod 72. Consequently, the hammer rail 28 is thrusted entirely upward.

When the hammer rail 28 is thrusted upward, the hammer regulating button 66 also moves upward. The upper face 40*a* of the catcher 40 does not contact the lower face 66*a* of the hammer regulating button 66 and the hammer 32 hits the string 90. Therefore, the string striking sound volume is not controlled. The sound volume corresponding to the intensity of the key depression can be normally obtained.

Even when the key is depressed with the same intensity, the sound volume of uncontrolled state (when the catcher 40 does not contact the lower face 66*a*) differs in sound volume of the controlled state (when the catcher 40 contacts the lower face 66*a*).

In the first embodiment, when the key 10 is depressed, the end 50*b* of the jack 50 is disconnected from the hammer butt 36, thereby commencing movement of the string striking portion 22. Subsequently, the lower face 66*a* of the hammer regulating button 66 contacts the upper face 40*a* of the catcher 40 just before the hammer 32 strikes the string 90, thereby damping the string striking movement and sound volume. Irrespective of the mechanical operation of the transmitting portion 24 composed of the jack 50 or other associated members at the time of key depression. Thus, without changing key operation or the feel of the key of the upright piano 1, the sound volume can be controlled. Also, no tone quality is changed, as in the case of the conventional muffler mechanism.

In the wire pedal mechanism 70, since rod 72 is connected to hammer rail 28, the amount of thrust of the hammer rail 28 may be adjusted by the amount of adjustment of adjusting bolt 80*a*. The contact between the hammer regulating button 66 and the catcher 40 is controlled by the operating portion 82.

Further, the amount of projection of the hammer regulating button 66 from the lower face of the hammer rail 28 can be adjusted. By increasing the amount of projection, the sound volume can be decreased or completely turned off. By decreasing the projecting amount, the sound volume can be increased or completely turned on (uncontrolled).

The sound volume is uncontrolled by operating the portion 82. The original position of the operating portion 82 (FIG. 2) is such that the sound volume is reduced. Only by operating the operating portion 82 (i.e. moving portion 82 in the direction of the arrow) does the sound volume increase. However, the invention is not restricted to this embodiment. Therefore, a modified embodiment may be obtained where the sound volume is decreased by operating the portion 82. Normal sound volume can be obtained when the portion 82 is not operated.

Figure 12:
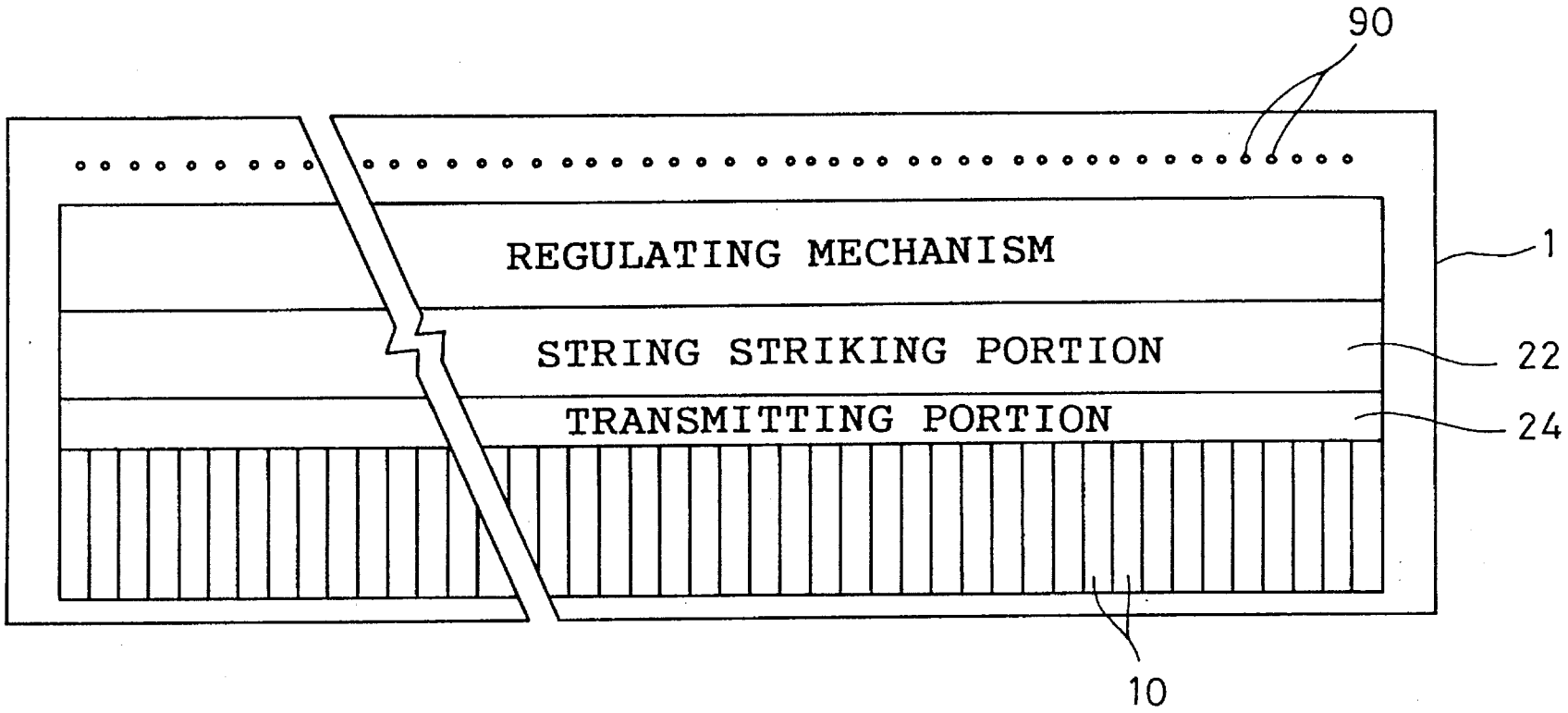
FIG. 12 diagrammatically shows a piano incorporating a plurality of keys, strings, and other related components according to the present invention.

In the aforementioned, only one key 10 of the upright piano is explained. Since the upright piano substantially have a plurality of strings, keys and other components, piano sound is controlled by the structure shown in FIG. 12.

In the first embodiment, by the provision of the hammer regulating button 66, after the hammer of the string striking portion 22 commences movement, the catcher 40 is stopped just before the hammer 32 strikes the string 90. The invention is not restricted to the aforementioned structure. Any member, other than the members associated with key depression which can stop the string striking movement at a specified position just before the hammer 32 strikes the string 90 without changing the key operation, may be used. For example, once the end 50*b* of the jack 50 is disconnected from the lower portion 36*a* of the hammer butt 36, the butt wire spring 44 or the bridle tape 60 can be stopped by an alternative member just before the hammer 32 strikes the string 90. Alternatively, by magnetizing the hammer 32 or the hammer shank 34 and placing a coil in close proximity to the hammer 32 or hammer shank 34, the hammer 32 or the hammer shank 34 can be stopped just before the hammer 32 hits the string 90 when electricity is applied to the coil.

SECOND EMBODIMENT

Figure 3:
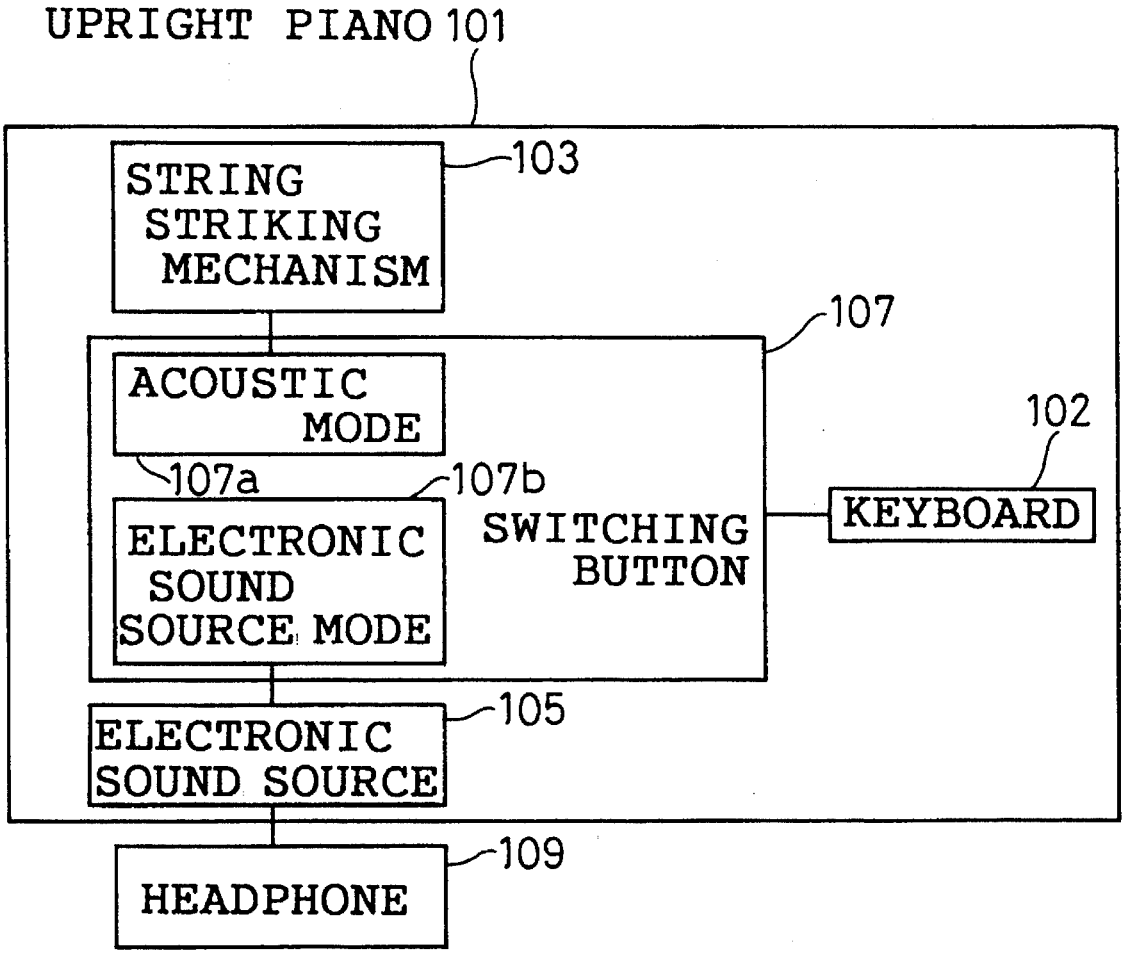
FIG. 3 is a block diagram showing the structure of a second embodiment.

As shown in FIG. 3, an upright piano 101 for the second embodiment has a built-in electronic sound source 105, in addition to a string striking mechanism 103. When a switching button 107 provided on the upright piano 101 is set to an acoustic mode 107*a*, the upright piano 101 is played as an acoustic piano by operating a keyboard 102 and the string striking mechanism 103. When the switching button 107 is set to an electronic sound source mode 107*b*, sounds are generated from the electronic sound source 105 by operating the keyboard 102. The sounds of the electronic sound source 105 can be heard from a headphone 109 connected to the output terminal of the upright piano 101.

Figure 4:
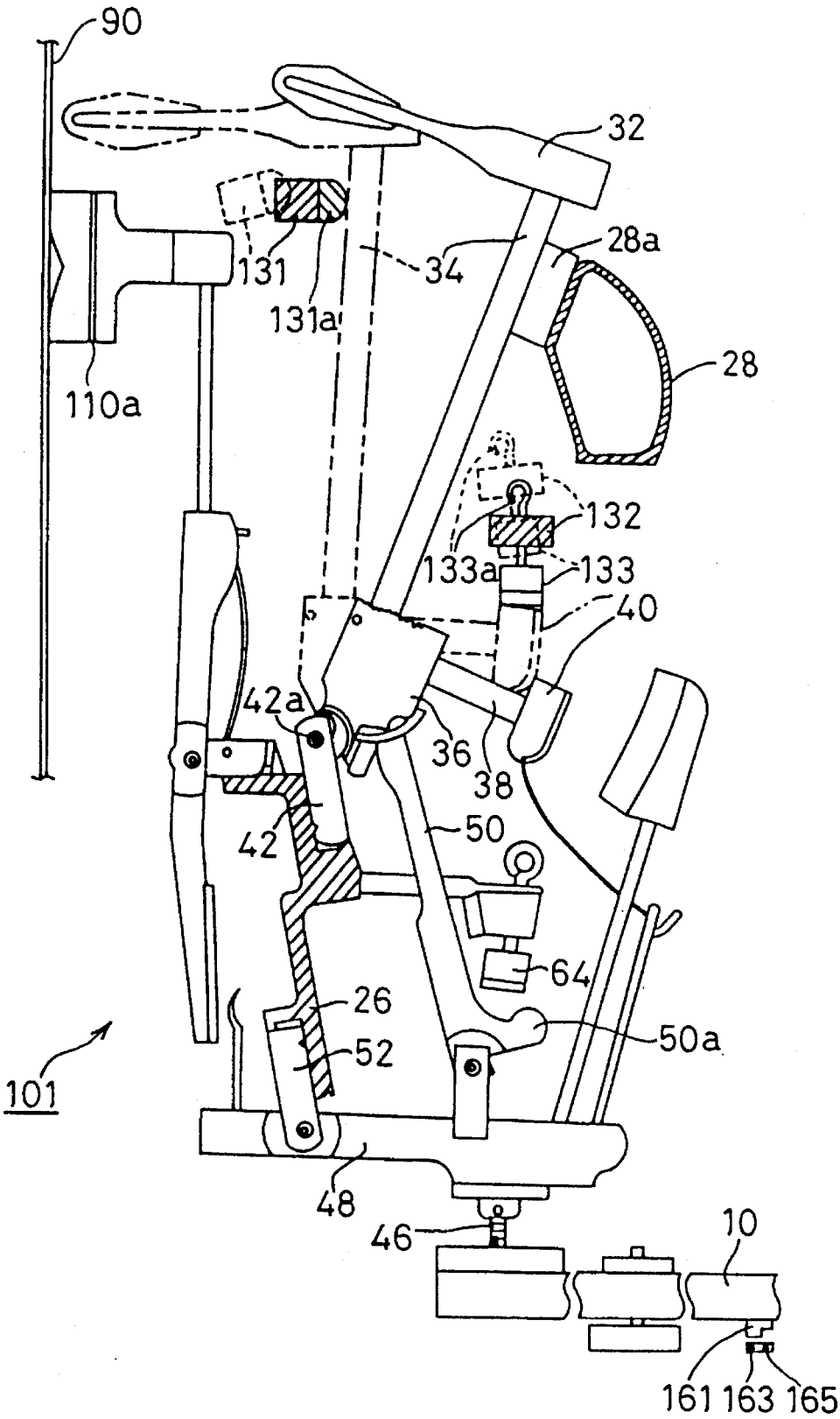
FIG. 4 is a diagrammatic representation showing the inside mechanism of the upright piano of the second embodiment.

The upright piano 101, shown in FIG. 4, is similar to the upright piano 1 for the first embodiment shown in FIG. 1. Therefore, the components of the upright piano 101 similar or identical to those of the upright piano 1 have the same reference numbers as those in FIG. 1. The explanation of such like components is omitted for the sake of simplicity.

Figure 5:
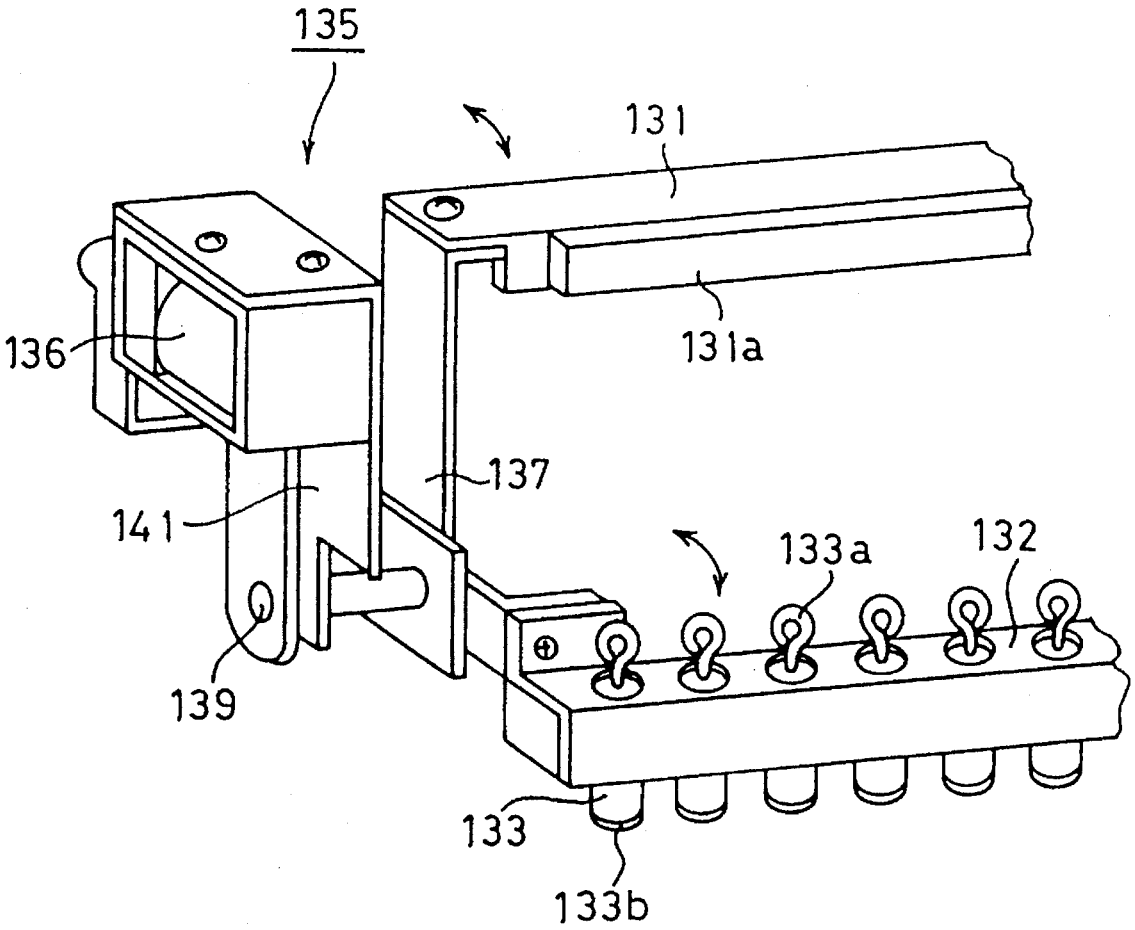
FIG. 5 is a perspective view showing a rail drive mechanism in the upright piano of the second embodiment.

In the second embodiment, instead of the hammer regulating button 66 of the first embodiment, a hammer shank stop rail 131 and a catcher regulating rail 132, as the inventive stopping member, are provided. As shown in FIG. 5, the hammer shank stop rail 131 and the catcher regulating rail 132 are both supported by a rail drive mechanism 135, which is firmly attached to both side ends of the upright piano 101. FIG. 5 shows the rail drive mechanism 135 only at the left end of the piano 101 for clarity.

As shown in FIG. 5, the rail drive mechanism 135 comprises a bracket 141 and a lever drive solenoid 136. The bent portion of an L-shaped link lever 137 is pivotably supported by a shaft 139, and the oscillating shaft 139 is positioned at the releasing position or the actuating position, as described later, by the lever drive solenoid 136.

The link lever 137 is firmly connected at one end to the hammer shank stop rail 131 and at the other end to the catcher regulating rail 132. The front face of the hammer shank stop rail 131 is covered with a cushioning felt 131*a*. Catcher regulating buttons 133 for regulating the respective catchers 40 are attached to the catcher regulating rail 132 by screws 133*a*. By manually turning the screw 133*a*, the amount of projection of the catcher regulating button 133 from the lower face of the catcher regulating rail 132 can be adjusted. The lower face of the catcher regulating button 133 is also covered with a cushioning felt 133*b*. The shaft 139 is positioned to either of the releasing and actuating positions by the lever drive solenoid 136. When the shaft 139 is positioned in its releasing position, the hammer 32 is allowed to strike the string 90. Specifically, the hammer shank stop rail 131 and the catcher regulating rail 132 are set to the positions shown by the dashed line in FIG. 4, thereby preventing contact with the hammer shank 34 and the catcher 40, respectively. The hammer 32 is thus allowed to strike the string 90. When is the shaft 139 is positioned in its actuating position, the hammer 32 is prevented from striking the string 90. Specifically, the hammer shank stop rail 131 and the catcher regulating rail 132 are set to the positions shown by the cross-hatched lines in FIG. 4, thereby contacting the hammer shank 34 and the catcher 40, respectively, at specified positions. As shown in phantom in FIG. 4, the hammer 32 is prevented from striking the string 90. The specified positions of the catcher regulating button 133 and the hammer shank stop rail 131 are respectively set between the position where the hammer butt 36 leaves the jack 50 and the position before the hammer 32 strikes the string 90. The lever drive solenoid 136 is driven responsive to the switching of the button 107 shown in FIG. 3. Therefore, when the switching button 107 is set to the acoustic mode 107*a*, the shaft 139 is positioned by the lever drive solenoid 136 no the releasing position. When the switching button 107 is set to the electronic sound source mode 107*b*, the shaft 139 is positioned in the actuating position.

The catcher regulating rail 132 is equivalent to a movable carriage; the lever drive solenoid 136 is equivalent to a positioning means; the catcher regulating button 133 is equivalent to a stopper; and the screw 133*a* is equivalent to an adjusting means. The position of the catcher regulating rail 132 shown by the solid line in FIG. 4 corresponds to the first position, and the position shown by the dashed line corresponds to the second position.

As shown in FIG. 4, a stopped shutter 161 and key sensors 163 and 165 for detecting the key depressing and releasing are located beneath the lower face of key 10. The key sensors 163 and 165 correspond to emitting and receiving elements. When the optical path between the emitting and receiving elements is interrupted, a signal is generated. When the key 10 is depressed, the stepped shutter 161, by virtue of the step in the stepped shutter, sequentially interrupts the optical path of the key sensors 163 and 165 thereby producing a time of interruption.

Figure 6:
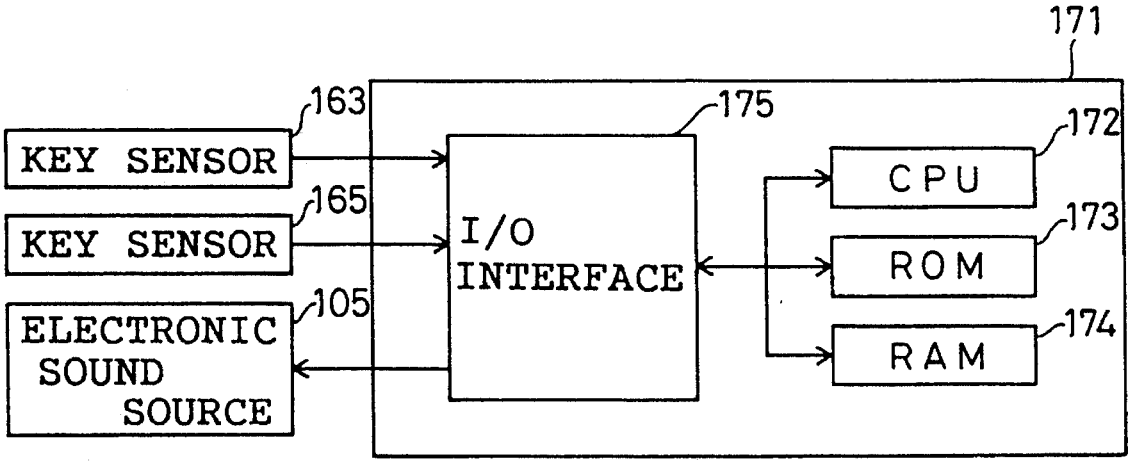
FIG. 6 is a block diagram showing the control unit for the upright piano of the second embodiment.

As shown in FIG. 6, the key sensors 163 and 165 are connected to a control unit 171. The control unit 171 is a logical operation circuit including CPU 172, ROM 173, RAM 174 and other known component. These components are connected via an input/output interface 175 to the key sensors 163 and 165. The CPU 172 detects the time period of interruption of the optical paths of the key sensors 163 and 165. Performance information is then prepared based on the control program stored in the ROM 173, and is transmitted to the electronic sound source 105.

The event data of the performance information is composed of one status byte and two data bytes. These three bytes comprise one unit of the performance information. The status byte includes data indicating depressing and releasing of the keys. The data byte includes the key number representing the sound pitch and the key depressing velocity representing the sound volume.

The control unit 171 is also connected to a pedal sensor for detecting the operation of a damper pedal, a soft pedal or other pedal. The damper function or other data is included in the performance information, based on the detection of a pedal sensor. The damper pedal is now explained with reference to FIG. 7. When the damper pedal is stepped on as is known, all the dampers 110*a* shown in FIG. 4 are detached from the string 90. The string 90 can therefore vibrate for a long time after the keys 10 are released. The piano sound volume and tone can thus be varied.

Figure 7:
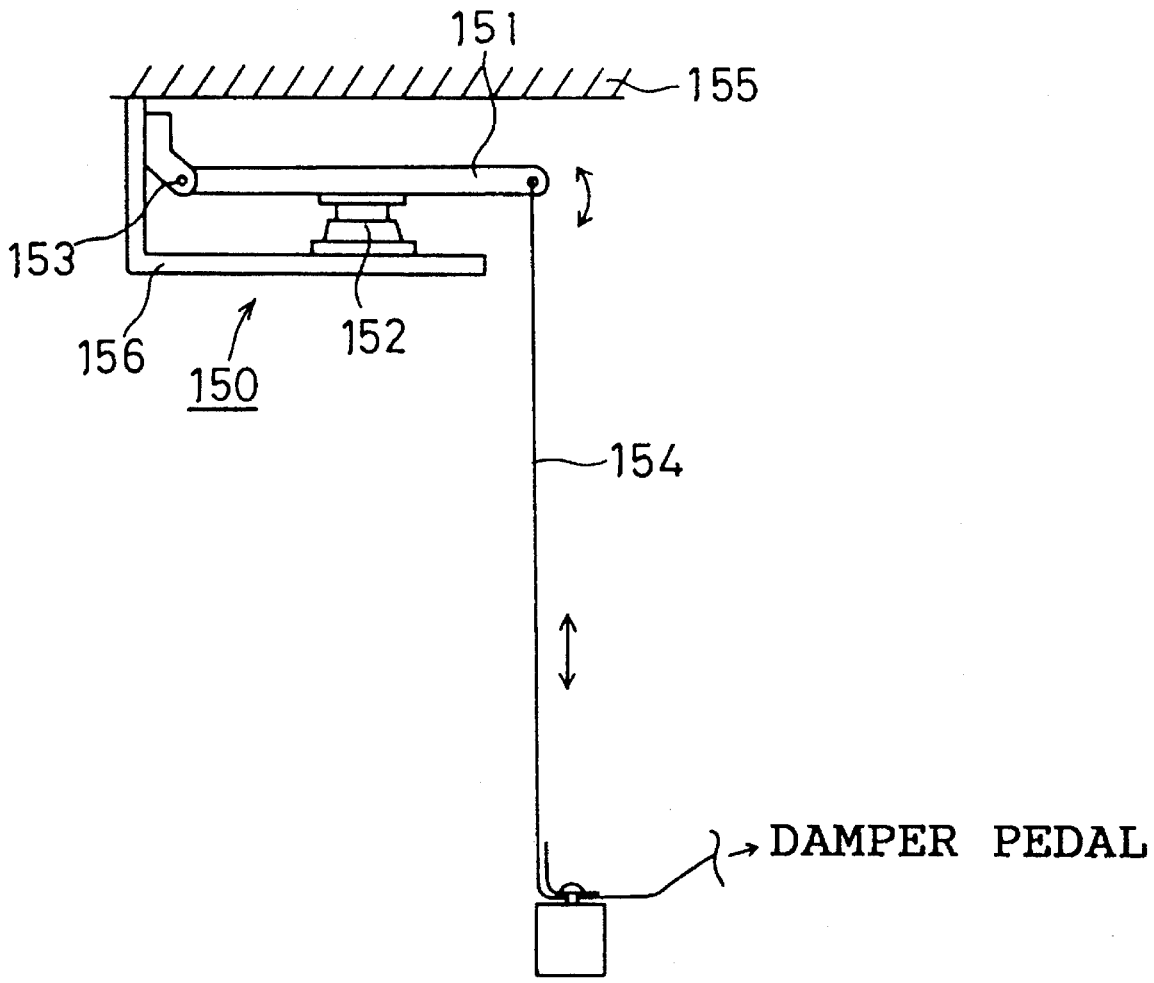
FIG. 7 is a diagrammatic representation showing a pedal sensor.
Figure 8:
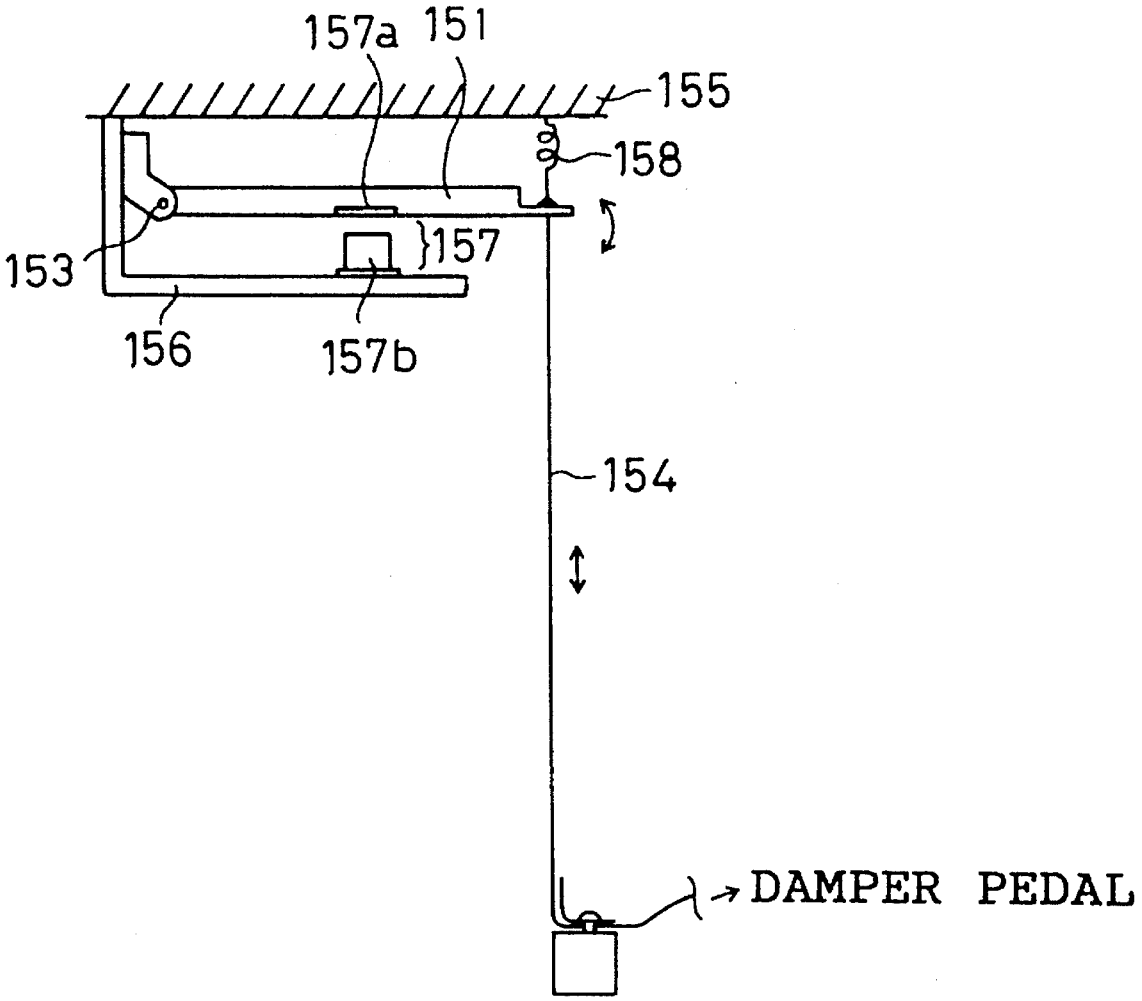
FIG. 8 is a diagrammatic representation showing another pedal sensor.

As shown in FIG. 7, the pedal sensor 150 is provided with a sensor lever 151 and a return switch 152. The sensor lever 151 is rotated upward and downward on a support 153 of a bracket 156 attached to a shelf 155. The end of the sensor lever 151 is connected, via a cord 154, to the end of the damper pedal. The return switch 152, which returns sensor lever 151 to an elevated position using an elastomer, is mounted under the center of the sensor lever 151. During operation of the pedal sensor 150, when the damper pedal is stepped on, the cord 154 is pulled downward thereby rotating the sensor lever 151 downward and activating the return switch 152. The generated signal is transmitted to the control unit 171 as damper pedal data. The data of sound volume and tone when the string 90 is vibrated for a long time is added to the performance information. When the damper pedal is released, the cord 154 is loosened, the sensor lever 151 is rotated upward because of the elasticity of the return switch 152 thereby turning off the return switch 152. The damper pedal data in the performance information then canceled. FIG. 8 shows an alternate embodiment of pedal sensor 150. Instead of return switch 152, a contact switch 157 can be mounted. A terminal 157*a* is attached substantially in the center of the sensor lever 151 and a terminal 157*b* is attached opposite to the terminal 157*a* onto the bracket 156. The contact switch 157 is turned off by a spring 158 attached to the shelf 155 causing the sensor lever 151 to rotate to its original position.

With the use of the pedal sensor 150, the amount of metal fixtures and the required accuracy for providing the sufficient switch function can be reduced, as compared to the conventional limit switch for detecting the movement of the balance interconnected with the damper pedal.

When the string striking sound is stopped and sound is generated from the electronic sound source 105, the switching button 107 of the control unit 171 is switched such that the upright piano 1 is placed into the electronic sound source mode 107*b*.

When a player depresses the key 10, the capstan button 46 is raised, thereby rotating the action lever 48 upward. The jack 50 together with the action lever 48 pushes the hammer butt 36 upward, thereby rotating the hammer shank 34 counterclockwise as viewed in FIG. 4. When the jack 50 is raised further, the jack tail 50*a* contacts the regulating button 64. The jack 50 is then rotated in a clockwise direction relative to the action lever 48. Subsequently, the hammer butt 36 leaves the jack 50 and starts moving together with the hammer shank 34. When the hammer shank 34 is in the position shown in phantom in FIG. 4, the hammer shank 34 contacts the cushioning felt 131*a* covering the front face of the hammer shank stop rail 131. Concurrently, as shown in phantom, the catcher 40 contacts the catcher regulating button 133. The hammer shank 34 is prevented from reaching the position where the hammer 32 strikes the string 90, thereby producing no string striking sound.

When the key 10 is depressed, the stepped shutter 161 shuts off the optical path between the emitting and receiving elements of the key sensors 163 and 165. The operation of keyboard 102 is then detected. Based on the detected operation, the performance information is prepared in the control unit 171 and is transmitted to the electronic sound source 105, thereby generating sound from the electronic sound source 105.

By stopping the movement of the hammer 32 when the key 10 is depressed, sound can be generated only from the electronic sound source 105, without generating any string striking sound. The movement of the hammer 32 is stopped after the hammer is already in motion. Therefore, the feel of the key 10 is the same as that when the hammer 32 strikes the string 90. For example, if the sound from the electronic sound source 105 is heard through the headphone 109, the player can play the upright piano 101 freely without worrying about a noise problem.

When the upright piano 101 is operated in the electronic sound source mode 107*b*, the cushioning felts 131*a* and 133*b* for stopping the hammer 32 of the frequently used key 10 is deformed and worn by the frequent contact with the hammer 32. After repeated use of the upright piano 101, the originally specified position for stopping the hammer 32 from striking the string 90 is gradually deviated toward the string 90.

By turning the screw 133*a* of the corresponding catcher regulating button 133, the contact position between the catcher 40 and the catcher regulating button 133 is adjusted. Adjustment is made by the catcher regulating button 133 such that the hammer 32 can be stopped from striking the string at the originally specified position. Such adjustment once again prevents the hammer 32 from contacting the string 90, because the catcher 40 is positioned to contact the catcher regulating button 133 before the hammer 32 reaches the string 90.

Even when repeated use of the upright piano 101 results in string striking sound during the sounding from the electronic sound source 105, by manually turning the screw 133*a* and adjusting the amount of projection of the catcher regulating button 133, the string striking sound can be consistently avoided. Frequent replacement of the cushioning felt 133*b* of the catcher regulating button 133 is obviated, thereby reducing costs.

Since the catcher regulating button 133 for contacting the catcher 40 is disposed under the hammer rail 28 on the front side of the piano 101, the screw 133*a* can be easily accessed without disassembling the string striking mechanism 103. The adjustment of the amount of projection of the catcher regulating button 133 is therefore simplified.

Since the movement of the hammer 32 is stopped only after it is already in motion, the feel of the key 10 is the same as that for generating the string striking under normal operation. The player perceives substantially the same key feel in both the acoustic mode 107*a* and the electronic sound source mode 107*b*.

Among the cushioning felts 133*b*, only the worn one need be replaced with a new one. Therefore, replacement is minimized and simplified.

The catcher regulating button 133 is originally positioned to contact the catcher 40. Alternatively, the button 133 can be positioned away from the catcher 40 while the hammer shank stop rail 131 acts as the stopper. After the cushioning felt 131*a* of the hammer shank stop rail 131 is deformed and worn, the catcher regulating button 133 can be positioned, by turning the screw 133*a*, to contact the catcher 40 and act as the stopper.

THIRD EMBODIMENT

Unlike the second embodiment, the third embodiment is not provided with the hammer shank stop rail 131. However, the catcher regulating rail 132 is utilized. As in the explanation of the second embodiments, like components are denoted with the same reference numbers as those in the first and second embodiment, and the explanation of such components is omitted.

Figure 10:
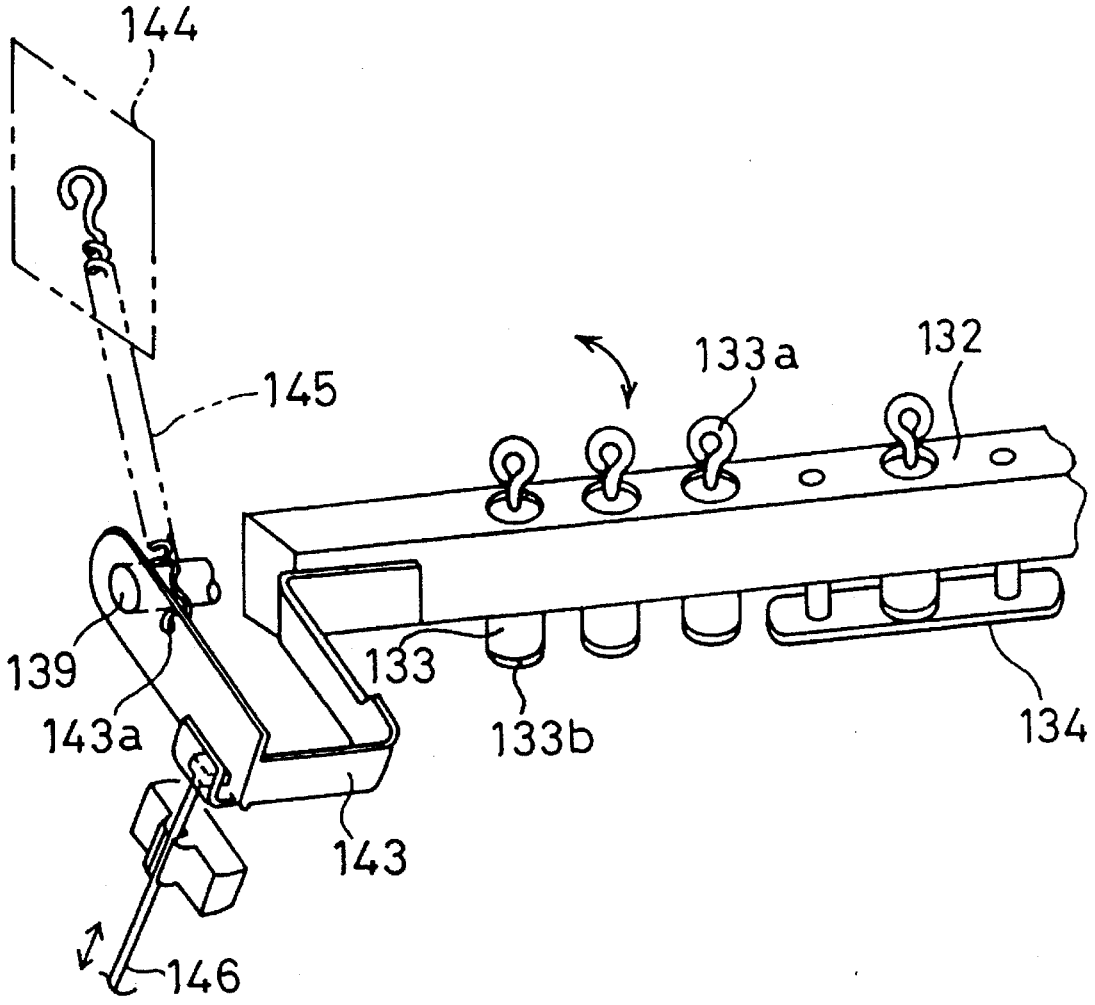
FIG. 10 is a perspective view showing a rail drive mechanism of the third embodiment.

As shown in FIG. 10, the catcher regulating rail 132 of the third embodiment is mechanically positioned and fixed at both side ends. The catcher regulating rail 132 is firmly attached to a substantially U-shaped bracket 143 and is pivotably supported on the shaft 139 of the bracket 143. Only the left end of the catcher regulating rail 132 is shown in FIG. 10 for clarity. A spring 145 is hooked between an eye 143*a* on the bracken 143 and a plate 144 on the inner face of the top plate of the upright piano 101, for biasing the catcher regulating rail 132 upward (counterclockwise). A wire 146 is connected to the bracket 143 to rotate the catcher regulating rail 132 downward (clockwise). The wire 146 is operated by a lever 149 in an operation box 148 under the shelf 155 shown in FIG. 11. The right end of the bracket 143, not shown, is not provided with a spring or a wire.

In the case of a group of infrequently used keys, as shown in FIG. 10, a single wider stopper 134 can be utilized for stopping the associated hammer or hammers from striking the associated string or strings. In FIG. 10, the stopper 134 is adjustable for controlling the striking motion of three hammers, for example.

Figure 9:
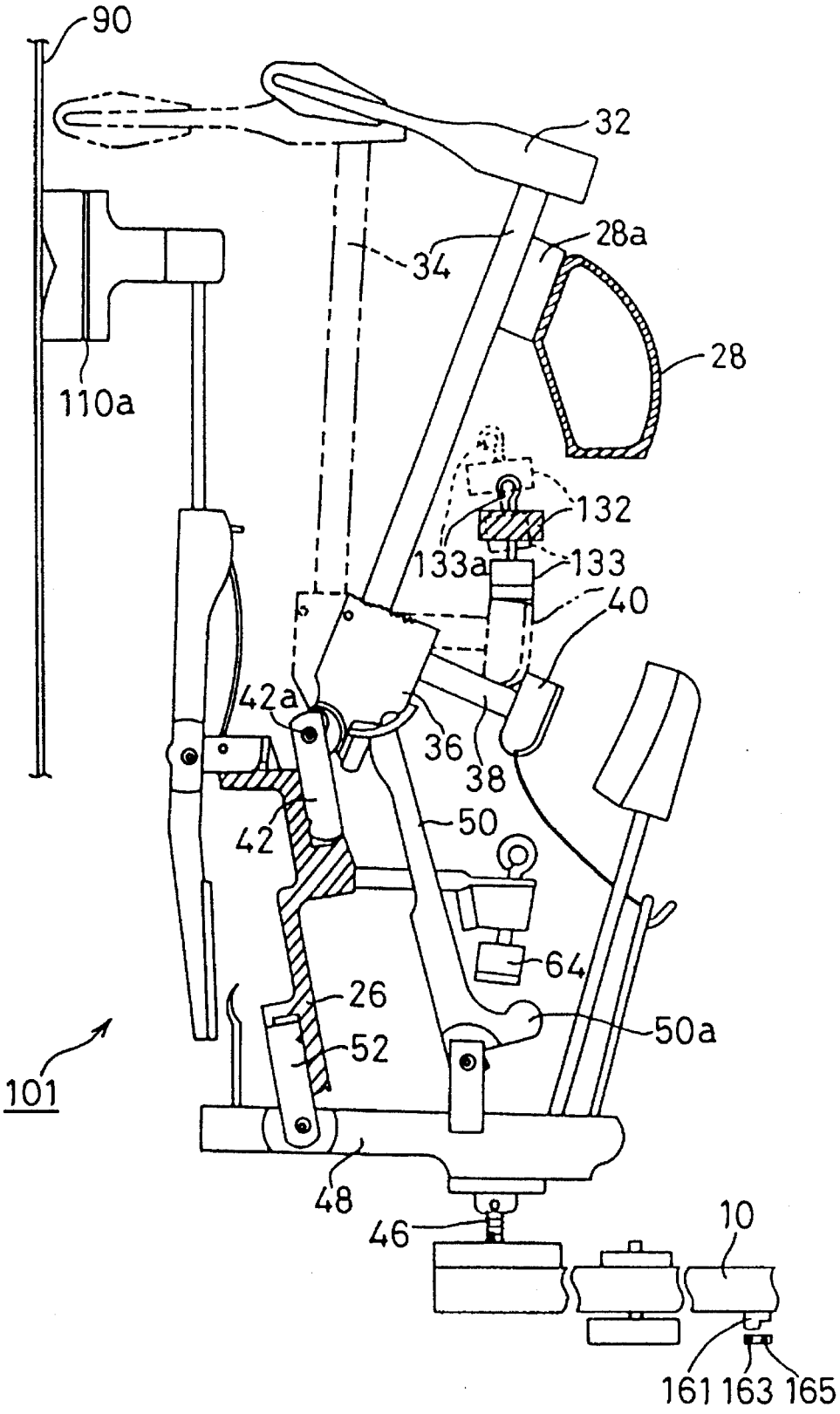
FIG. 9 is an explanatory view showing the inside mechanism of the upright piano of a third embodiment.
Figure 11:
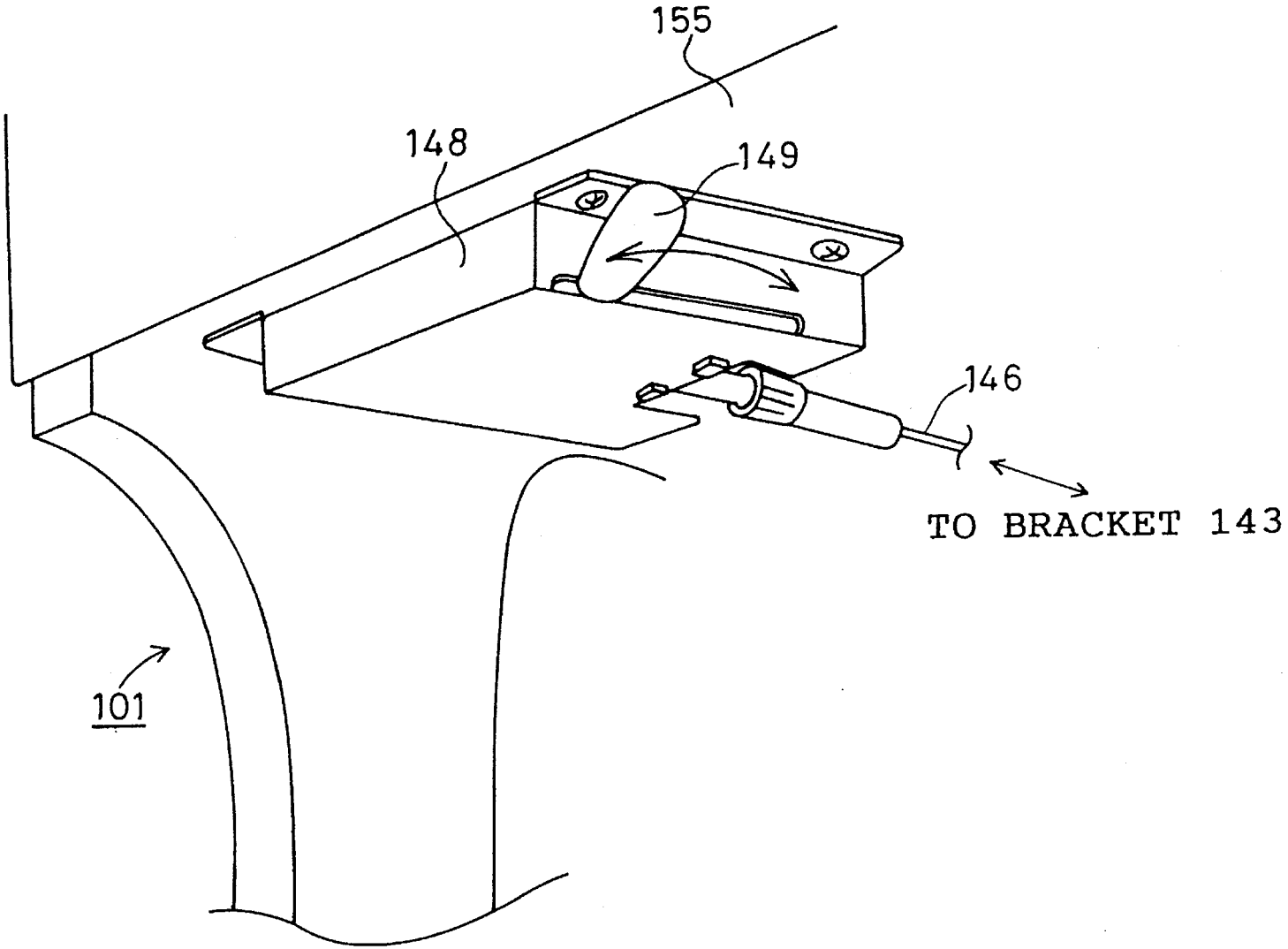
FIG. 11 is a perspective view showing a driving lever for the rail drive mechanism of the third embodiment.

As shown in FIG. 11, when the lever 149 in the operation box 148 is positioned toward a front side of the piano 101, the switching button 107 of the control unit 171 is set to the electronic sound source mode 107*b*. Concurrently, the wire 146 is pulled and the bracket 143 is rotated downward against the bias of the spring 145. The catcher regulating rail 132 is positioned to its actuating position as shown by the cross-hatched line in FIG. 9. When the lever 149 is positioned toward the backside of piano 101, the switching button 107 is set to the acoustic mode 107*a*. Concurrently, the wire 146 is loosened and the bracket 143 is rotated upward, due to the bias of the spring 145. As a result, the catcher regulating rail 132 is positioned to its releasing position as shown by the dashed line in FIG. 9. The function and effectiveness of the catcher regulating rail 132 are the same as those in the second embodiment.

The lever 149 is provided with a not shown stopper ball and an urging member for urging the stopper ball into a receiving member within the operation box 148. When the lever 149 is positioned toward the front or back side, the stopper ball is urged by the urging member and is firmly engaged in the corresponding ball receiving portion of the operation box 148 to prevent the lever 149 from moving from the front or back position due to vibration, for example.

This invention has been described above with reference to the preferred embodiments as shown in the figures. Modifications and alterations may become apparent to one skilled in the art upon reading and understanding the specification. Despite the use of the embodiments for illustration purposes, the invention is intended to include all such modifications and alterations within the spirit and scope of the appended claims.

In the embodiments, a key range corresponds to one key, and the catcher regulating button 133 is provided for each key. However, one key range can include two or more keys. The number of keys in each key range can be varied with the frequency of the use. For example, the frequently used key range can cover one key, while the infrequently used key range covers two or more keys.

The second and third embodiments are applied to an upright piano with a built-in electronic sound source. If these embodiments are applied to the upright piano connected to an external electronic instrument, however, the resulting effectiveness is the same as that in the embodiments.

Furthermore, the mechanism according to the invention can be mounted on an automatic performing piano. In such piano, the keyboard is operated based on the automatic performance data, while the sound can be heard through a headphone, thereby causing no noise problem due to string striking sound.

As aforementioned, according to the present invention, although the electronic sound source is used, after repeated use a string striking sound may be generated. However, the stopping member can be easily adjusted without disassembling the string striking mechanism or other components to once again prevent string striking sound from being produced.

What is claimed is:

1. A piano comprising:

a keyboard having at least one key;

at least one string for generating sound;

a hammer system comprising at least one hammer, said at least one hammer being arranged to strike said at least one string in response to a depression of said at least one key;

a mechanical arrangement interconnecting said at least one key with said at least one hammer, and said mechanical arrangement being operable to cause said at least one hammer to move to a string striking position; and a regulating mechanism for regulating, at a position following initiation of movement of said at least one hammer but prior to said at least one hammer striking said at least one string, moving inertia of said at least one hammer to achieve a desired sound generation of said at least one string;

wherein said regulating mechanism comprises a wire pedal mechanism with a wire interconnecting said pedal mechanism with said regulating mechanism, and said wire pedal mechanism is operable, via said wire, to move said regulating mechanism to operable and inoperable positions and vise versa.

2. The piano according to claim 1 wherein said regulating mechanism, when in the operable position, preventing said at least one hammer from striking said at least one string.

3. The piano according to claim 1 wherein said regulating mechanism, when in the inoperable position, permitting said at least one hammer to strike said at least one string without affecting the moving inertia of said at least one hammer.

4. A piano comprising:

a keyboard having at least one key;

at least one string for generating sound;

a hammer system comprising at least one hammer, said at least one hammer being arranged to strike said at least one string in response to a depression of said at least one key;

a mechanical arrangement interconecting said at least one key with said at least one hammer, and said mechanical arrangement being operable to cause said at least one hammer to move to a string striking position; and a regulating mechanism for regulating, at a position following initiation of movement of said at least one hammer but prior to said at least one hammer striking said at least one string, moving inertia of said at least one hammer to achieve a desired sound generation of said at least one string, wherein said regulating mechanism comprises:

a wire;

a lever connected to a first end of said wire and a bracket connected to a second end of said wire;

a catcher regulating rail, for regulating the moving inertia of said at least one hammer, supported by said bracket; and a resilient biasing means attached to said catcher regulating rail for biasing said catcher regulating rail to an inoperative position;

whereby said lever is operable to move said catcher regulating rail to an operative position, in which said catcher regulating rail regulates the moving inertia of said at least one hammer, and an operative position where said catcher regulating rail is unable to regulate the moving inertia of said at least one hammer.

5. A piano comprising:

a keyboard having a plurality of keys divided into a plurality of key ranges;

a plurality of strings for generating desired sound;

a hammer system comprising a plurality of hammers, each of said plurality of hammers being arranged to strike a corresponding one of said plurality of strings in response to a depression of a corresponding one of said plurality of keys;

a mechanical arrangement interconnecting each of said plurality of keys with a corresponding one said plurality of hammers, and said mechanical arrangement being operable to cause a desired one of said plurality of hammers to move to a string striking position;

an electronic sound source being coupled to said plurality of keys for generating, when desired, electronic sound in response to a key depression;

stop means for stopping, when said electronic sound source is utilized for generating desired electronic sound, each hammer of a said key range at a specified position during a string striking movement; and the specific position for each said key range being individually adjustable, wherein said stop means comprises:

a movable carriage;

positioning means for moving said movable carriage from a first operable position to a second inoperable position and vice versa;

a stop member supported by said movable carriage for engaging each said hammer of a said key range; and adjusting means for adjusting a position of said stop member relative to said movable carriage;

whereby, when said movable carriage is moved to its first operable position by said positioning means, said stop member is positioned to stop each corresponding hammer at the specified position and prevent each corresponding hammer from striking the corresponding string and, when said movable carriage is moved to its second inoperable position by said positioning means, said stop member is positioned to allow each corresponding hammer to strike each corresponding string.

6. The piano according to claim 5 wherein said stop means is positionable to contact a hammer catch mechanism supported by each corresponding hammer.

* * * * *